United States Patent [19]

Lee

[11] 4,169,743

[45] Oct. 2, 1979

[54] ZIRCONIUM-BASE ALLOY NUCLEAR FUEL CONTAINER AND METHOD

[75] Inventor: Daeyong Lee, Scotia, N.Y.

[73] Assignee: General Electric Company, Schenectady, N.Y.

[21] Appl. No.: 854,974

[22] Filed: Nov. 25, 1977

Related U.S. Application Data

[63] Continuation of Ser. No. 535,271, Dec. 23, 1974, abandoned.

[51] Int. Cl.[2] ..... C22C 1/18

[52] U.S. Cl. ..... 148/32; 148/133

[58] Field of Search ..... 75/177; 148/133, 11.5 F, 148/12.7, 32, 32.5

[56] References Cited

U.S. PATENT DOCUMENTS

| | | | |
|---|---|---|---|
| 2,894,866 | 7/1959 | Picklesines | 148/133 |
| 3,005,706 | 10/1961 | Thomas et al. | 75/177 |
| 3,125,446 | 3/1964 | Johnson et al. | 75/177 |
| 3,963,534 | 6/1976 | Frenkel et al. | 148/133 |

FOREIGN PATENT DOCUMENTS

| | | | |
|---|---|---|---|
| 622550 | 6/1961 | Canada | 75/177 |
| 859053 | 12/1970 | Canada | 75/177 |

OTHER PUBLICATIONS

Metallurgy of Common Cladding Materials, M. Kangilaski, Reactor Materials, vol. 13, No. 1, Spring 1970.
AEC Contract Report, AT-11-1-GEN-14, Feb. 1973, WAPD-TM-1972, The Corrosion of LWBR Zircalloy End Cap Weldments, Abstract and pp. 7, 9, 24. 33 27s-Welding Research Supplement, Jan. 1956, pp. 27s-31s.
WAPD-120, U.S. Atomic Energy Commission, Production Annealing of Zircaloy 2, 1968, pp. 6-17.
Ells et al., "The Irridation Response of a Group of Complex Zirconium Alloys", *Irradiation Embrittlement and Creep in Fuel Cladding and Core Components,* The British Nuclear Energy Society, London, 1972, pp. 43-46.

*Primary Examiner*—L. Dewayne Rutledge
*Assistant Examiner*—Peter K. Skiff
*Attorney, Agent, or Firm*—Leo I. MaLossi; Joseph T. Cohen

[57] ABSTRACT

A fast neutron-irradiated zirconium-base alloy body having load-carrying capacity substantially greater than similar conventional zirconium-base alloy bodies likewise irradiated is produced by subjecting a body heat treated at 930° C. and then water-quenched and containing 0.2 weight percent beryllium and at least 95 weight percent zirconium to integrated neutron flux approximating $1.2\times10^{21}$ nvt while maintaining the body at about 330° C.

2 Claims, 3 Drawing Figures

ZIRCONIUM-BASE ALLOY NUCLEAR FUEL CONTAINER AND METHOD

This is a continuation of application Ser. No. 535,271 filed Dec. 25, 1974 now abandoned.

The present invention relates generally to materials of construction of nuclear reactors and is more particularly concerned with a novel zirconium-base alloy nuclear reactor structural member or body having unique corrosion resistance, ductility and load-carrying capacity (resistance to stress corrosion) and possibly corrosion resistance in the irradiated condition.

CROSS REFERENCE

This invention is related to that disclosed and claimed in copending patent application Ser. No. 535,419, filed Dec. 23, 1974, abandoned in favor of Ser. No. 934,948 filed Aug. 18, 1978, allowed, in the names of Rodney E. Hanneman, Daeyong Lee and Craig S. Tedmon, Jr., which is based on the concept that a small amount of lanthanum or praseodymium will substantially improve the slow strain rate ductility of certain zirconium-base alloys and on the additional concept that these new zirconium alloys and certain others in the irradiated condition can under certain circumstances have surprising load-carrying capacity.

BACKGROUND OF THE INVENTION

Important requirements for materials used in boiling water nuclear reactor construction include low absorption for thermal neutrons, corrosion and stress corrosion resistance and mechanical strength. Zirconium-base alloys sufficiently satisfy these requirements that they are widely used for such purposes, "Zircaloy-2" (containing about 1.5 percent tin, 0.15 percent iron, 0.1 percent chromium, 0.05 percent nickel and 0.1 percent oxygen) and "Zircaloy-4" (containing substantially no nickel but otherwise similar to Zircaloy-2) being two of the important commercial alloys commonly finding such use. These alloys, however, are not nearly all that one would desire, particularly in respect to useful service life, despite many efforts of others during the past two decades to improve them.

Mainly, these efforts have been aimed at improving corrosion resistance and usually this has involved changes in composition. Thus, in U.S. Pat. No. 3,005,706, it is proposed that from 0.03 to 1.0 percent of beryllium be added to zirconium alloys intended for use in conventional boilers, boiling water reactors and similar apparatus. Similarly, in U.S. Pat. Nos. 3,261,682 and 3,150,972, cerium and/or yttrium additions and a calcium addition, respectively, are proposed as zirconium alloy additions in like proportions for the same purpose. Accounts and reports of the results of such compositional changes are sparse, however, and the present commercial alloys do not include any of these additional constituents.

The literature in this field, however, contains little concerning efforts to improve upon the mechanical strength of zirconium-base alloys and particularly the load-carrying capacity of fuel cladding and other reactor parts subjected to prolonged exposure to typical boiling water reactor conditions. This is in spite of the fact that it has long been general knowledge that slow strain rate ductility of these alloys is lost to a great extent as a result of radiation exposure over periods of a year or more. The problem of premature termination of service life because of fast neutron radiation-induced embrittlement is particularly aggravated in the case of nuclear fuel containment channels and tubes or cladding. The natural swelling of the fuel as it is burned produces high localized stresses leading to stress-corrosion cracking of the cladding at a time before corrosion of the type described in the above patents might normally necessitate cladding replacement.

THE INVENTION

This invention, which is predicated on my discovery and new concept to be described, provides an answer to both the iodine stress-corrosion problem and the embrittlement problem in the form of a process which can result in doubling the length of the service life of zirconium-base alloy nuclear fuel cladding. Moreover, this result is obtained without incurring any significant offsetting cost or performance disadvantage.

My discovery is that a zirconium-base alloy of the kind presently used in nuclear reactors will have a much greater load-carrying capacity after being subjected to fast neutron radiation for a period of a year or so if it contains from 0.5 to 0.25 percent beryllium. More specifically, such an alloy will characteristically exhibit 500 to 600 percent greater load-carrying capacity (i.e., uniform strain to maximum load) than conventional beryllium-free cladding and can therefore be expected to serve in that use and environment much longer and possibly twice as long as the zirconium-base alloys in general use in nuclear reactors.

My new concept is to prepare a zirconium-base alloy containing 0.05 to 0.25 percent beryllium for use as nuclear fuel cladding by heating to a temperature of the order of 900° C. and then water-quenching it. Although such heat treatment results in a phase transformation, the zirconium alloy transforming in part or totally from the alpha to the beta phase, and the prior art warns that detrimental effects on mechanical properties will result, I have found that there are substantial advantages to be gained by effecting such transformation. For one thing, ductility is enhanced materially, as will subsequently be described in more detail. For another, resistance to corrosion under boiling water nuclear reactor conditions resulting in heavy oxide coating formation on fuel cladding may thereby be substantially reduced or limited, as set forth more fully and generically claimed in copending patent application Ser. No. 552,794, filed Feb. 25, 1975, abandoned in favor of Ser. No. 852,906, filed Nov. 18, 1977.

In its method aspect, this invention in brief description includes the steps of forming a zirconium-base alloy body containing 0.05 to 0.25 percent beryllium, heating the body to a temperature above 900° C. and then quenching, and finally subjecting the body to boiling water reactor conditions for a long period of time such as a year or more. More specifically, the alloy body will be of at least 95percent zirconium, the quenching will be done with water and the nuclear reactor conditions will be a temperature of about 325° C. and a fast-neutron flux of 1.0 to $10.0\times10^{21}$ nvt.

In its product or article aspect, this invention takes the form of a zirconium-base alloy body of substantially greater load-carrying capacity than similar conventional bodies of the alloy irradiated in the same way and to the same extent and having at 325° C. an unique combination of physical properties including 2.5 percent uniform elongation, 8.2 percent total elongation and 35 percent area reduction, yield strength greater than 76,000 psi, and tensile strength greater than 80,000 psi. In more specific terms, the body is a nuclear fuel container for use in a nuclear reactor, and is in the form of a tube having microstructure in which the intermetallic phase is to some extent segregated at the grain boundaries as a consequence of the heat treatment and quenching steps stated above. Additionally, the fuel container or cladding is irradiated as a result of having been subjected for a long period to fast-neutron flux and has greater load-carrying capacity than a counterpart fuel container similarly irradiated but containing no berrylium.

DETAILED DESCRIPTION OF THE INVENTION

Figure 1:
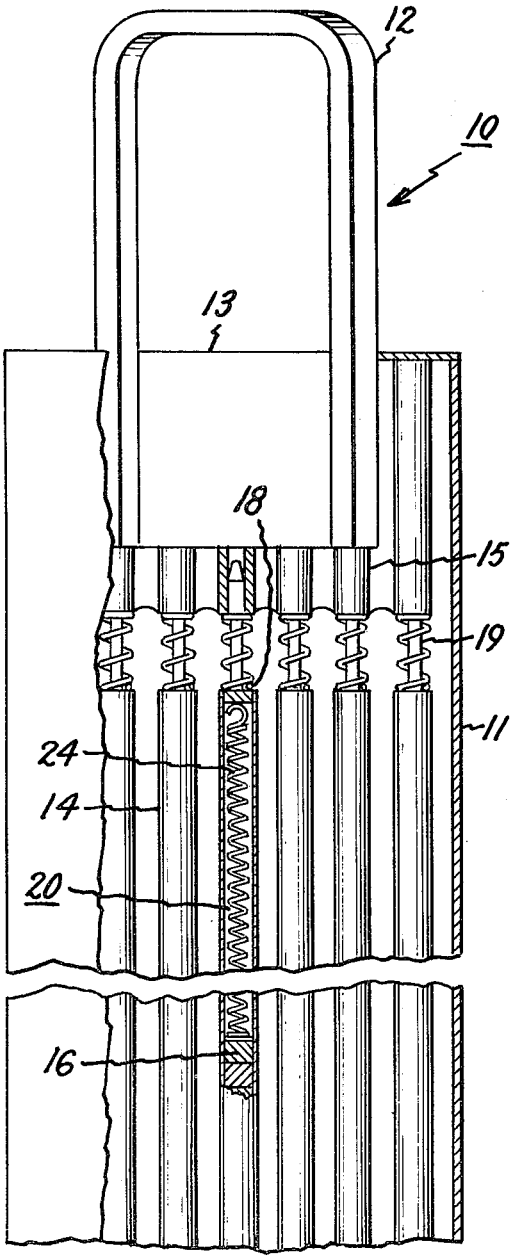
FIG. 1 presents a partial cutaway sectional view of a nuclear fuel assembly containing nuclear fuel elements constructed according to the teaching of this invention.

As indicated by FIG. 1, a primary application of the present invention is for the fabrication of nuclear fuel assemblies such as that illustrated at 10 consisting of a tubular flow channel 11 of generally square cross section provided at its upper end with lifting bale 12 and at its lower end with a nose piece (not shown due to the lower portion of assembly 10 being omitted). The upper end of channel 11 is open at 13 and the lower end of the nose piece is provided with coolant flow openings. An array of fuel elements or rods 14 is enclosed in channel 11 and supported therein by means of upper end plate 15 and a lower end plate (not shown due to the lower portion being omitted). The liquid coolant ordinarily enters through the openings in the lower end of the nose piece, passes upwardly around fuel elements 14, and discharges at upper outlet 13 in a partially vaporized condition for boiling water reactors or in an unvaporized condition for pressurized reactors at an elevated temperature.

The nuclear fuel elements or rods 14 are sealed at their ends by means of end plugs 18 welded to the cladding 17, which may include studs 19 to facilitate the mounting of the fuel rod in the assembly. A void space or plenum 20 is provided at one end of the element to permit longitudinal expansion of the fuel material and accumulation of gases released from the fuel material. A nuclear fuel material retainer means 24 in the form of a helical member is positioned within space 20 to provide restraint against the axial movement of the pellet column, especially during handling and transportation of the fuel element.

The fuel element is designed to provide an excellent thermal contact between the cladding and the fuel material, a minimum of parasitic neutron absorption, and resistance to bowing and vibration which is occasionally caused by flow of the coolant at high velocity.

Cladding 17 is produced in accordance with this invention by a process which includes in addition to the usual tube-forming operations a heat treatment in argon or other inert atmosphere above the alpha-alpha plus beta transformation temperature followed by a water quench. The rate at which the work piece is heated up to the transformation temperature range is a matter of choice, but the time it is maintained in that range is preferably about 30 seconds and the cooling rate down to 700° to 750° C. may be as low as 50° C. per second. As so treated, the zirconium alloy body is made more easily workable and forming operations are facilitated through the warm-working stage. It also appears, as indicated above, that the physical properties and particularly the ductility of the ultimate cladding product may be considerably enhanced in this manner. As a further advantage, depending upon the nature of the finishing operations involved in producing the cladding, the tendency toward corrosion may be to a large extent suppressed as a consequence of the heat treatment above the alpha-alpha plus beta transformation temperature of about 810° C. This latter effect would be attributable, possibly, to the segregation of the intermetallic phase at the grain boundaries, as set out in the aforesaid copending application, Ser. No. 552,794. In any event, the zirconium alloy employed in this process is one which contains beryllium in amount from 0.05 to 0.25 weight percent, and preferably also contains about 1.5 weight percent tin and 0.05 weight percent nickel, and at least 95 weight percent zirconium. In other words, it is preferably either Zircaloy-2 or Zircaloy-4.

The method and products of this invention are set forth in more detail together with actual test results in the following illustrative example in which Zircaloy-2 was used, being melted in an electric arc furnace under vacuum to provide control specimens as well as test specimens meeting the special compositional requirements of this invention.

EXAMPLE

Of the total of seven test specimens, four were of commercial Zircaloy-2 composition and the others differed therefrom only in that they each contained 0.2 weight percent beryllium. These specimens in the form of cast buttons about 2.5 inches in diameter and about one-half inch thick were machined to provide a smooth surface and then wrapped in zirconium foil, offset-forged approximately 30 percent, heated to 930° C. in argon and then again offset-forged. They were sandblasted and wrapped again in zirconium foil and reheated to 930° C. for 20 minutes and water-quenched. The four specimens (Nos. 1, 3, 4 and 5 in Table I below) containing no beryllium were then rolled to ultimate thickness of one-sixteenth inch by a multiple pass method, the final passes being cold-rolling operations. These sheets were sandblasted, pickled in aqueous 2.0 percent HF and 6.0 percent $HNO_3$, and then Specimens 1 and 3 were finally annealed at 650° C. for one hour while Specimens 4 and 5 were annealed at 580° C. for four hours. Beryllium-containing Specimens 2, 6 and 7 were processed in the same manner as Specimens 4 and 5 through the final annealing stage. Specimens 1 and 2 were maintained at 327° C. (620° F.) in a neutral atmosphere for one year, and Specimens 3, 4, 5, 6 and 7 were exposed to fast-neutron radiation at temperatures of either 250° C. or 327° C. for the same twelve-month period, being located within standard-size fuel cladding dummy fuel rods installed in fuel bundles in a working boiling water reactor core. Flux wires of nickel and iron indicated that these specimens were subjected to radiation exposure, peaking at $3.1\times10^{21}$ nvt for corresponding peak fast flux values of $7\times10^{13}$ n/cm$^2$-sec. Thus, the typical specimen of this series was exposed to the fast flux over a period of one to 1½ years in a neutral or an inert helium atmosphere at the temperature indicated in Table I.

The results of all of the tests made on these irradiated and unirradiated specimens are set out in Table I:

TABLE I

| Specimen | Neutron Fluence $10^{21}$ | Test Temp, °C. | Oxygen ppm wt | Yield Strength (0.2%) psi | Tensile Strength, psi | Uniform Elong, % | Total Elong, % | Reduction of area, % |
|---|---|---|---|---|---|---|---|---|
| 1 | — | 327 | 1500 | 22,400 | 28,400 | 16.4 | 30.6 | 79.9 |
| 2 | — | 327 | 1200 | 27,100 | 37,600 | 16.0 | 27.8 | 56.8 |
| 3 | 1.5 | 327 | 1500 | 73,800 | 75,200 | 0.35 | 5.9 | 42 |
| 4 | 1.5 | 250 | 920 | 56,500 | 56,700 | 0.45 | 8.0 | 44 |
| 5 | 1.4 | 250 | 1600 | 74,600 | 76,000 | 0.80 | 9.3 | 53 |
| 6 | 1.2 | 250 | 1200 | 78,600 | 84,800 | 3.30 | 8.6 | 37 |
| 7 | 1.2 | 327 | 1200 | 76,800 | 81,200 | 2.50 | 8.2 | 35 |

The test temperature stated in Table I is the temperature at which the mechanical properties of the specimen were tested in each instance, all these specimens being subjected to the same 327° C. temperature environment over the twelve-month period under the conditions as set forth above.

Figure 2:
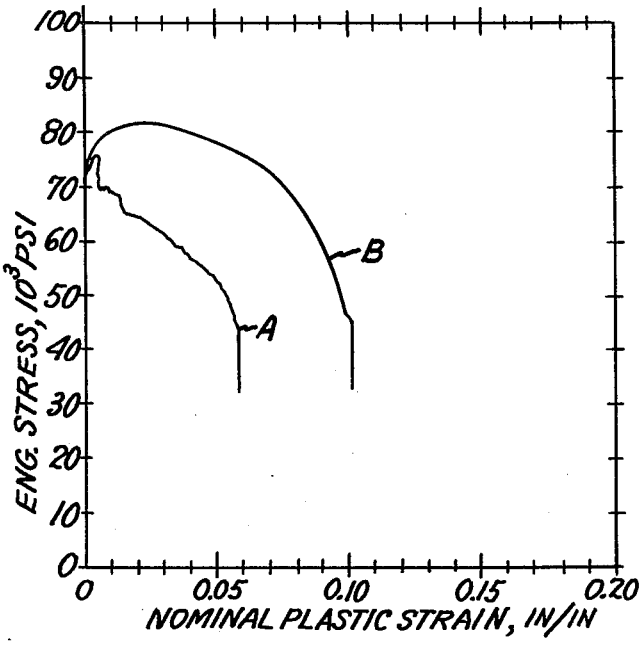
FIG. 2 is a chart bearing curves illustrating physical property data obtained in tests of the new product of this invention and the corresponding prior art product.

The effect of the beryllium addition is demonstrated in FIG. 2 where the dramatic difference in load-carrying capacity between Specimens 3 and 7 is indicated by Curves A and B, respectively. Also, it will be noted in this connection that in Table I the same inherent characteristic is reflected in the uniform strain-to-maximum-load which increased from 0.35 percent in Specimen 3 to 2.5 percent in Specimen 7, a net increase over 600 percent. The tests yielding these data were conducted at a strain rate of $8.3\times10^{-4}$ cm/cm/sec. Metallographic examination of these two specimens revealed that deformation was noticeably more diffuse in Specimen 7 than in Specimen 3.

Figure 3:
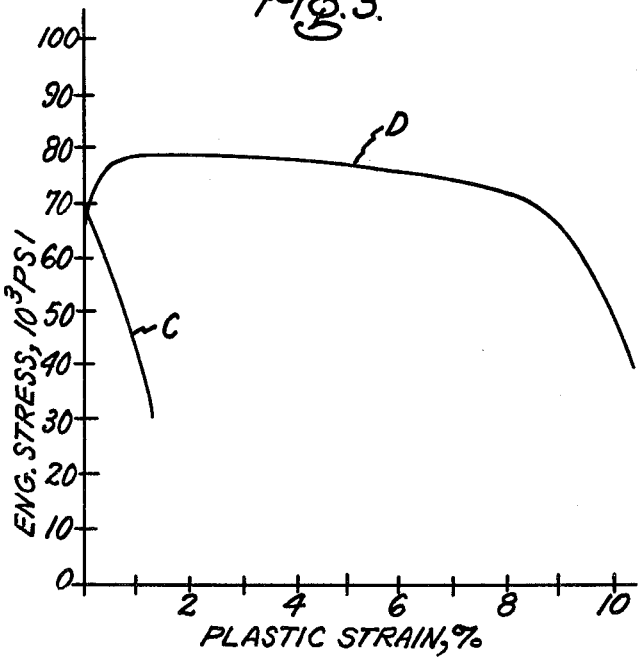
FIG. 3 is another chart on which stress is plotted against strain and the curves illustrate data taken in tests performed under an iodine atmosphere.

The effect of the beryllium addition is further illustrated in FIG. 3 where, again, there is a dramatic difference in strength between Specimens 3 and 7 as indicated by Curves C and D, respectively. As previously noted, the tests resulting in the data represented by these curves were conducted in an aggressive environment (i.e., under an iodine atmosphere) at a strain rate of $2.83\times10^{-6}$ cm/cm/sec.

The iodine atmosphere tests were conducted by subjecting the work piece at 325° C. in each case to an atmosphere of helium gas containing iodine in amount approximating the room temperature iodine partial pressure. Thus, helium gas is flowed continuously through an iodine crystal bed from which it entered the test chamber. Helium gas flow through the chamber was continuous as the pressure within the chamber was maintained slightly greater than atmospheric pressure.

What I claim as new and desire to secure by Letters Patent of the United States is:

1. A fast neutron-irradiated zirconium-base alloy body selected from the group consisting of Zircaloy-2 and Zircaloy-4 containing from 0.05 to 0.25 weight percent beryllium and having substantially greater load-carrying capacity than similar conventional zirconium-base alloy bodies irradiated in the same way and to the same degree, and having at 327° C. an unique combination of physical properties including 2.5 percent uniform elongation, 8.2 percent total elongation and 35 percent area reduction, yield strength greater than 76,000 psi, and tensile strength greater than 80,000 psi.

2. The zirconium-base alloy of claim 1 containing 0.2 weight percent beryllium.

* * * * *